US006170117B1

(12) United States Patent
Batt

(10) Patent No.: US 6,170,117 B1
(45) Date of Patent: Jan. 9, 2001

(54) MULTIPLE RAKE SOOTBLOWER WITH INTERNAL VALVING MANIFOLD

(75) Inventor: Paul J. Batt, Wellsville, NY (US)

(73) Assignee: ABB Air Preheater, Inc., Wellsville, NY (US)

( * ) Notice: Under 35 U.S.C. 154(b), the term of this patent shall be extended for 0 days.

(21) Appl. No.: 09/440,455

(22) Filed: Nov. 15, 1999

(51) Int. Cl.[7] ..... F23J 3/02
(52) U.S. Cl. ..... 15/318.1; 122/392
(58) Field of Search ..... 15/316.1, 318, 15/318.1; 122/379, 390, 392

(56) References Cited

U.S. PATENT DOCUMENTS 1,750,548 * 3/1930 Thomas ..... 122/392
1,785,821 * 12/1930 Snow ..... 15/316.1
2,659,630 * 11/1953 Angstaft ..... 15/316.1 X
4,173,808 * 11/1979 Blaskowski ..... 15/316.1
4,209,028 * 6/1980 Shenker ..... 122/392 X
5,293,663 * 3/1994 McCullough ..... 15/318.1

* cited by examiner

*Primary Examiner*—Chris K. Moore
(74) *Attorney, Agent, or Firm*—Alix, Yale & Ristas, LLP

(57) ABSTRACT

A multiple rake sootblower reciprocates over an area to clean an entire surface using a minimum of space for the sootblower stroke. An internal valving manifold and a plurality of bushings inside of a plenum isolate the rakes from each other and operate one rake at a time. This maintains the required sootblowing media pressure at the nozzles of each of the rakes. The internal valving manifold may either be reciprocated or rotated to select the desired rake.

5 Claims, 5 Drawing Sheets

MULTIPLE RAKE SOOTBLOWER WITH INTERNAL VALVING MANIFOLD

BACKGROUND OF THE INVENTION

The invention relates generally to sootblowers used for cleaning surfaces that are subject to ash fouling. Specifically, the invention involves multiple rake sootblowers with internal valving manifolds.

In the design of sootblowers for any particular application, there are three basic goals. The first goal is to provide complete coverage of the entire area that is subject to ash fouling. Second, sufficient sootblowing media pressure should be available at each nozzle. The third goal is to minimize the space requirements for the stroke of the sootblowers to provide the complete coverage.

In the case of a long but narrow area such as heat exchanger plates, there are two common rake-type sootblower designs which are often used. One involves the use of a plurality of single rake sootblowers, usually side by side, to cover a long, narrow area. Each one of the rakes only needs a short stroke to cover its assigned area. This requires an actuator for each rake and the rakes are operated one at a time so that each rake has sufficient sootblowing pressure. The other design is the half-track design. This usually uses two rakes extending into a long area from opposite ends with each rake covering one half of the long, narrow area although there are other variations. This design requires one actuator for each of the two rakes. There are usually more nozzles in each of the two rakes than with the single rake design which results in reduced sootblowing pressure at each nozzle. Therefore, it can be seen that each of these designs has its limitations and disadvantages.

SUMMARY OF THE INVENTION

An object of the invention is to provide a sootblower with a minimum of space required for the sootblower stroke, with complete coverage, with sufficient sootblowing media pressure at each nozzle and with simple controls. The invention involves a multiple rake sootblower with an internal valving manifold to isolate each of the multiple rakes and select which of the multiple rakes is actuated. As many rakes are provided on a single sootblower as are needed to cover the area and minimize the stroke. The valving maintains the media pressure at each one of the many nozzles.

DESCRIPTION OF THE PREFERRED EMBODIMENTS

Figure 1:
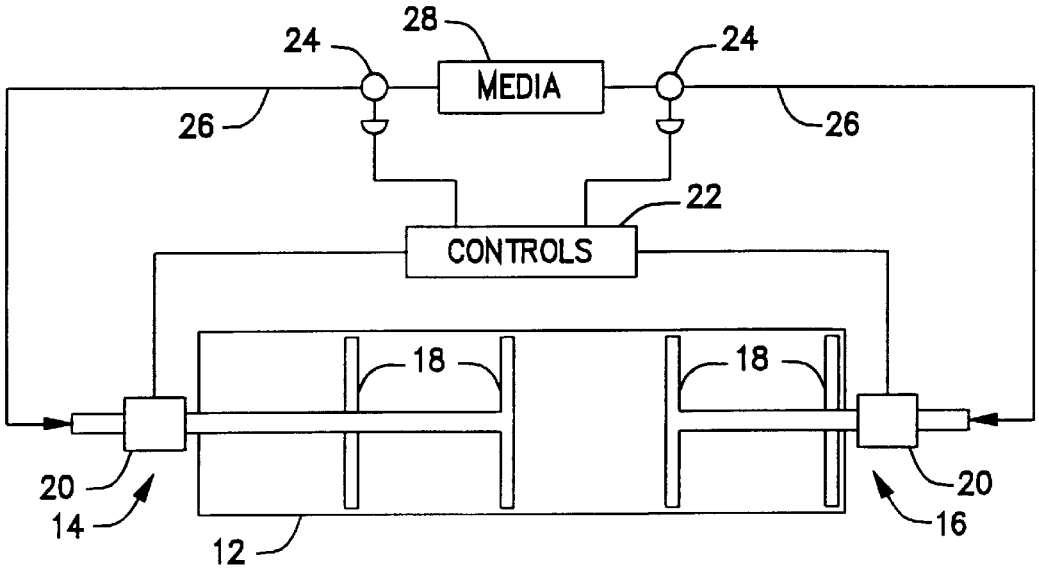
Figure 1 (Prior Art)
FIG. 1 illustrates a sootblower arrangement of the prior art including a control system using a half-track sootblower design to cover an area.
Figure 2:
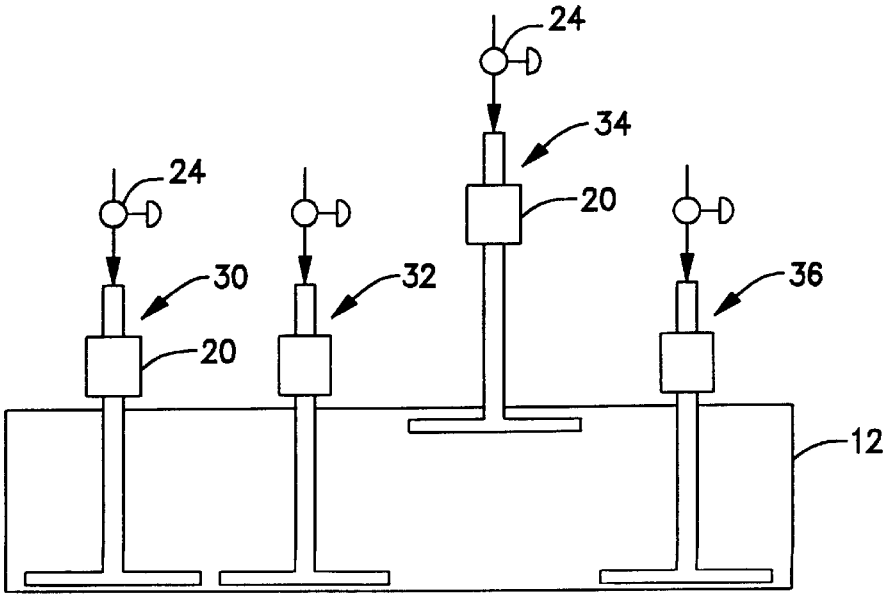
Figure 2 (Prior Art)
FIG. 2 illustrates another sootblower arrangement of the prior art using a plurality of single rake sootblowers to cover a similar area.

For comparison purposes, FIGS. 1 and 2 illustrate prior art rake-type sootblower arrangements. FIG. 1 is a so-called half-track sootblower arrangement with the area to be covered defined by the long, narrow rectangle 12. This area can, for example, be all or a portion of a heat exchanger plate that is subject to ash fouling from flue gas. In this half-track arrangement, one rake-type sootblower 14 extends into the long, narrow area from one end while the other sootblower 16 extends into the area from the other end. In this arrangement, each one of the sootblowers covers one half of the area. Each sootblower is illustrated as having two rakes 18 and the sootblower 14 is shown fully inserted while the sootblower 16 is shown fully withdrawn. It can be seen that the stroke of each sootblower to obtain complete coverage of the area 12 is equal to about the distance between the rakes 18. For an area 40 feet long and with the two rakes per sootblower, the stroke of each sootblower is about 12 feet. Of course, for longer areas, more rakes could be used on each sootblower or the stroke could be increased.

The sootblowers are driven in and out by the drive means generally indicated at 20 which can be any conventional sootblower drive means. The drive means 20 are connected into and actuated by the control unit 22. This control unit 22 also operates the valves 24 in the lines 26 between the source 28 of the sootblowing medium and the sootblowers 14 and 16. The sootblowing medium is normally high pressure air or steam. Since each sootblower has a plurality of rakes and a considerable number of total nozzles, and even though the sootblowers are operated one at a time, the sootblowing pressure to each nozzle is reduced (over that of a single rake sootblower) or a higher pressure media source must be used.

The second prior art arrangement is shown in FIG. 2 and employs a plurality of single rake sootblowers 30, 32, 34 and 36 side by side and entering from the side of the long dimension of the area 12. Only a short stroke is required to cover the narrow dimension of the coverage area. For example, to cover a 40 foot by 10 foot area, four sootblowers side by side as shown each with a stroke of 12 feed are used. In this arrangement, four drives 20 and four valves 24 are required and these would be connected into a control unit similar to that shown in FIG. 1. Once again, these sootblowers would be operated one at a time to assure sufficient media pressure.

Figure 3:
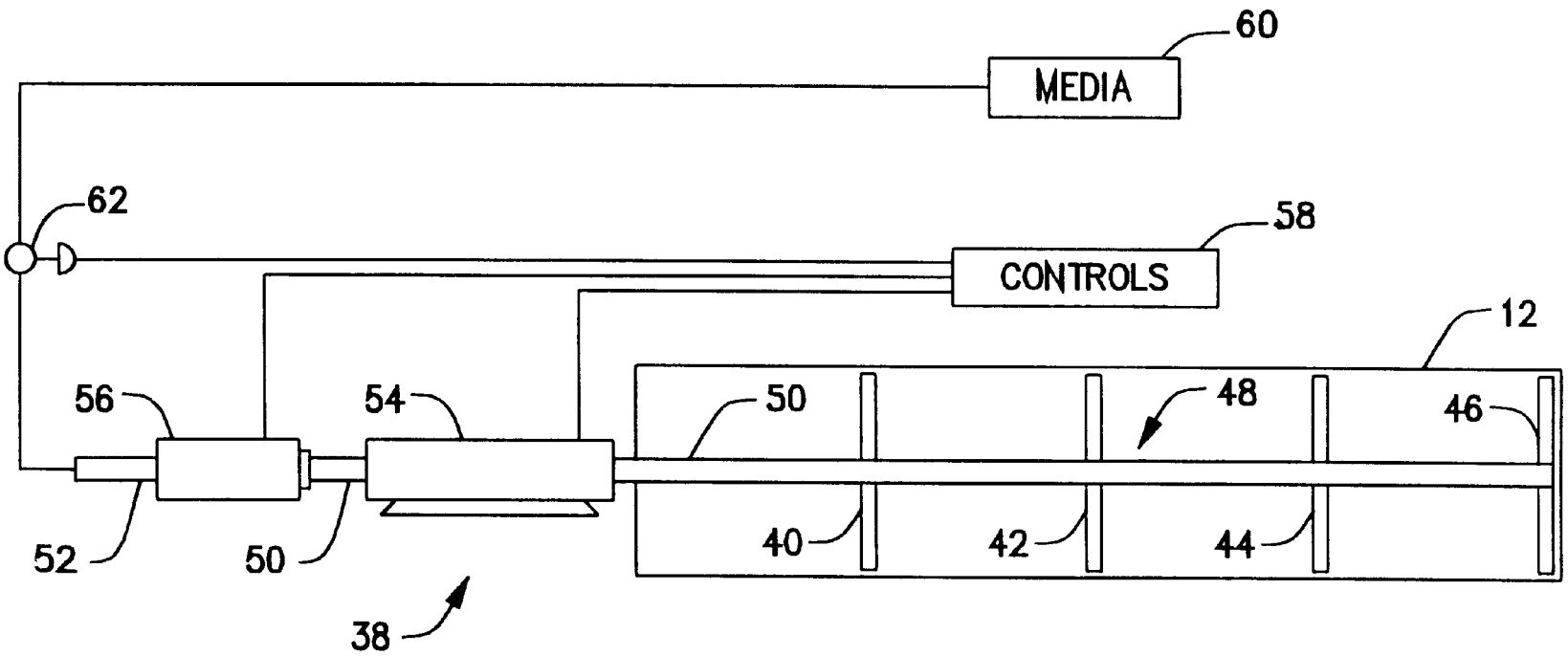
FIG. 3 illustrates the general arrangement of a sootblower of the present invention.

The general sootblower arrangement of the invention is illustrated in FIG. 3. This involves a single sootblower 38 having multiple rakes to cover the same area 12. In this example of the invention, there are four rakes 40, 42, 44 and 46 on the sootblower although the number of rakes can be varied. The sootblower comprises an outer manifold 48, which comprises a plenum 50 and the previously mentioned rakes 40, 42, 44 and 46, and an inner manifold 52 as will be described in detail later. The outer manifold 48 is driven by the drive unit 54 in the same manner as the prior art sootblowers previously described. The drive unit 54 may be any desired type of linear drive but the preferred type employs a traveling carriage assembly to which the plenum 50 is mounted. The traveling carriage is reciprocated by a chain which is connected through a gearbox to an electric motor. Such a drive is commercially available from ABB Power Products Mfg., Boiler Cleaning Equipment Div., of Chattanooga, Tenn. The inner manifold 52 is driven in relation to the outer manifold 48 by the drive unit 56. It will be seen later that this drive unit 56 may either reciprocate or rotate the inner manifold 52. When the inner manifold 52 is reciprocated, the drive unit 56 may be mounted to the end of the plenum 50 and be of the same chain drive type just described. The operation of the outer and inner manifolds is controlled by the control unit 58 as is the flow of sootblowing medium from the source 60 through the valve 62 to the inner manifold 52.

Figure 4:
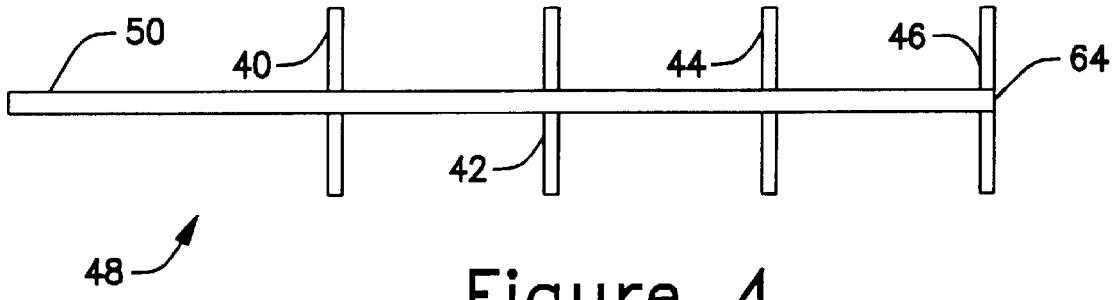
FIG. 4 is a plan view of the outer manifold of the invention.
Figure 5:
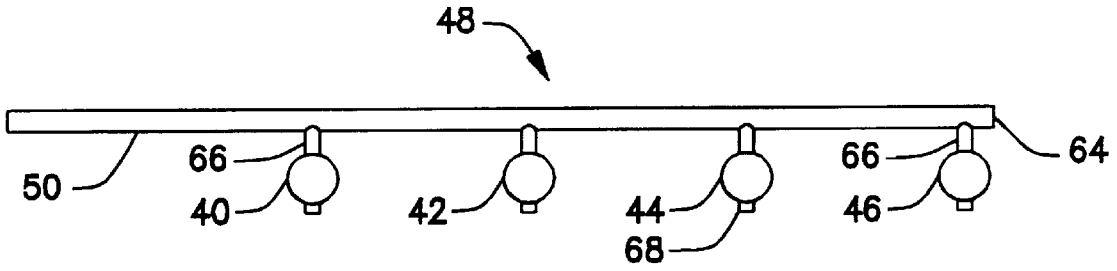
FIG. 5 is a side elevation view of the outer manifold of FIG. 4.
Figure 6:
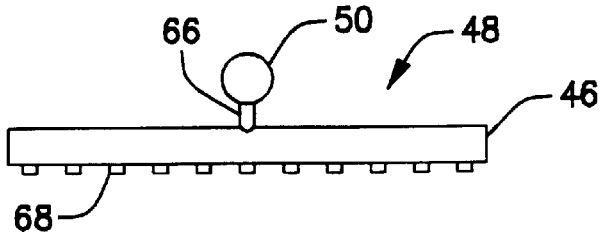
FIG. 6 is an end view of the outer manifold.

FIGS. 4, 5 and 6 show the structure of the outer manifold 48 which comprises the plenum 50 and the rakes 40, 42, 44 and 46. The plenum 50 is a tube closed at the end 64 with the interior of the tube connected through the holes 65 to the nipples or small tubes 66 and to the interior of the tubes comprising the rakes 40, 42, 44 and 46. Each of the rakes is provided with a series of nozzles 68 which direct the sootblowing media onto the surface to be cleaned. Although these nozzles have been illustrated only on one side of the rakes, nozzles can be located anywhere around the rakes as desired.

Figure 7:
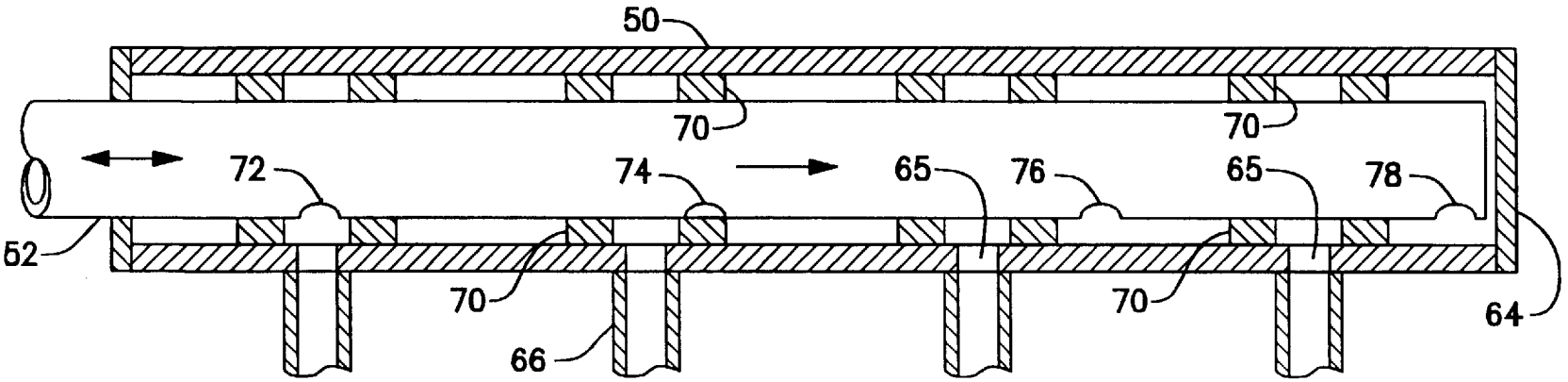
FIG. 7 is a side elevation view partially in cross section of an inner manifold of the indexing type inside of an outer manifold.

FIG. 7 shows a sootblower assembly according to one embodiment of the invention which is referred to as the indexing version. Inside of the plenum 50 are bushings 70 on each side of each of the holes 65 and the nipples 66. Extending through the center of the plenum 50 and through the bushings 70 is the inner manifold 52. This inner manifold 52 is a tube which has holes or openings 72, 74, 76 and 78 communicating with the interior of the tube. This inner manifold 52 is connected to the sootblowing media as shown in FIG. 3. The openings 72, 74, 76 and 78 are spaced along the inner manifold as shown in FIG. 7 such that only one of the openings at a time lines up with a hole 65 and a nipple 66. As seen in FIG. 7, the opening 72 lines up with a hole 65 and a nipple 66 while the other openings 74, 76 and 78 are not lined up with nipples. In this position, the sootblowing media inside of the inner manifold 52 exits only through the opening 72 and into the corresponding nipple and rake which would be the rake 40 in FIG. 3. The entire sootblower would then be reciprocated for the rake 40 to cover its assigned area. The inner manifold 52 is then indexed to the next position within the outer manifold 50 which involves moving the inner manifold axially with the drive unit 56 such that the opening 74 lines up with the hole 65 and the nipple 66 associated with the rake 42. In that position, the other three openings will not be lined up with nipples. The procedure of reciprocating the sootblower would then be repeated. The same procedure for indexing the inner manifold and reciprocating the sootblower would then be followed with respect to the openings 76 and 78.

Figure 8:
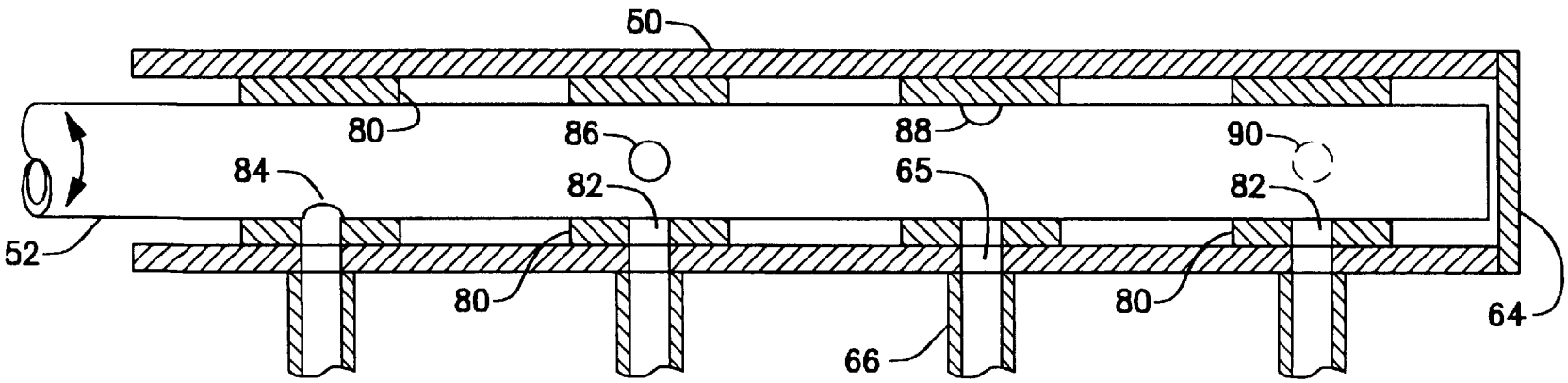
FIG. 8 is a side elevation view partially in cross section of an inner manifold of the rotary type inside of an outer manifold.

The embodiment of the invention shown in FIG. 8 is the rotary version with the inner manifold 52 being rotated to line up the openings in the inner manifold with the nipples 66. In this version, the bushings 80 inside of the outer manifold 50 are solid bushings surrounding each of the holes 65 and the nipples 66 each with a hole 82 which is lined up with one of the holes 65 and nipples 66. The inner manifold has openings or holes 84, 86, 88, and 90 with each opening being located inside of one of the bushings 80 and being located at staggered positions around the inner manifold as seen in FIG. 8. With four rakes, these holes are offset from each other by 90°. As shown, the opening 84 is lined up with a hole 82, a hole 65 and a nipple 66 while the other holes 86, 88 and 90 are not so aligned. Therefore, the rake 40 of FIG. 3 would be the only rake being supplied with the sootblowing media. The same general procedure as previously described with respect to the indexing version would be followed with the exception that the inner manifold 52 would be rotated to line up holes instead of moved axially as with the indexing version. In this case, the drive unit 56 would be a drive which rotates the inner manifold the required increments. Once again, such a drive can be mounted on the end of the plenum 50 and be of any desired type. For example, an electric motor can be connected with a drive gear which engages a gear attached to the inner manifold 52.

Figure 9A:
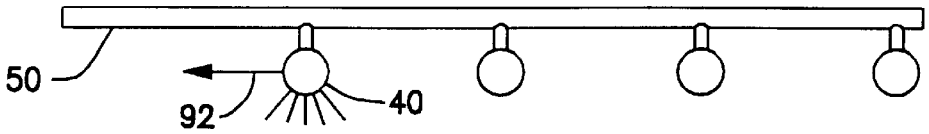
FIGS. 9A to 9D illustrate the operating cycle of the invention.
Figure 9B:
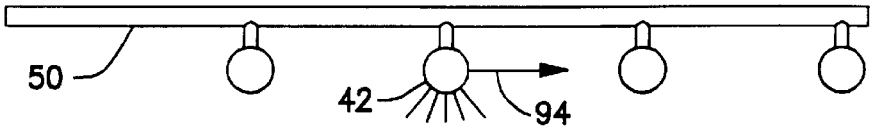
Figure 9C:
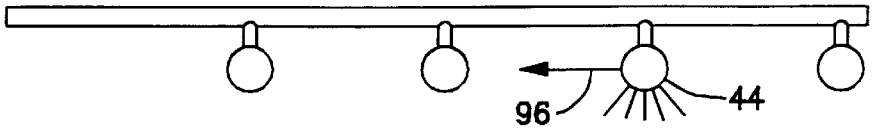
Figure 9D:
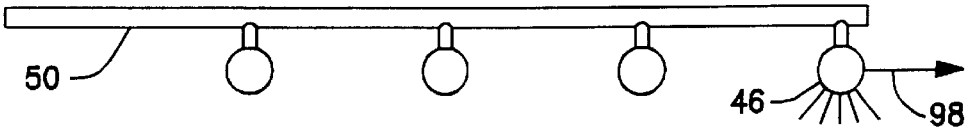

FIGS. 9A to 9D show the operating cycle of the invention. In FIG. 9A, the rake 40 is actuated and the sootblower is moved in the path and direction shown by the arrow 92 to cover a first area. Then, in this new position, the rake 42 is actuated and the sootblower moved in the path and direction of the arrow 94 as shown in FIG. 9B to cover a second area. The procedure is continued with the rake 44 and path 96 as in FIG. 9C and with the rake 46 and path 98 as in FIG. 9D to complete the coverage of the areas.

With the invention, there is no theoretical limit to the number of rakes on a single sootblower. This allows the addition of rakes to cover a longer area or to reduce the required stroke to cover a given area. Further, each rake is isolated thereby providing full sootblower media pressure to each rake as contrasted to the half-track design of the prior art previously described. Additionally, a single sootblower with multiple rakes has the same coverage as two half-track sootblowers or four or more single-rake sootblowers. Only one drive unit is required for the outer manifold and one for the inner manifold and only one valve is required regardless of the number of rakes.

Although the invention has been illustrated in the drawings as having the rakes 40, 42, 44 and 46 perpendicular to the plenum 50, the rakes can also be parallel to the plenum. Such an arrangement is particularly applicable for a rotary regenerative heat exchanger where the sootblower extends generally radially across an end of the rotor and blows into the moving rotor.

What is claimed is:

1. A rake-type sootblower comprising:

a. an axially movable outer manifold comprising:

i. an axially extending tube defining a plenum, ii. a plurality of rakes attached to said tube, said rakes each containing a plurality of sootblowing nozzles, and iii. connecting means between said tube and each of said rakes including openings in said tube providing for the flow of sootblowing media from said plenum into said rakes and out of said nozzles;

b. bushing means inside of said plenum associated with each of said connecting means for isolating said connecting means from each other;

c. an inner manifold extending through said plenum and through said bushing means and connected to a source of sootblowing media for providing said sootblowing media to the inside of said inner manifold;

d. a hole in said inner manifold associated with each of said connecting means and rakes for the flow of sootblowing media from said inner manifold into each of said connecting means and rakes; and e. means for moving said inner manifold with respect to said outer manifold and said bushing means to selectively and alternately align each of said holes in said inner manifold with said associated connecting means to alternately provide for the flow of sootblowing media from said inner manifold into each of said connecting means and rakes.

2. A rake-type sootblower as recited in claim 1 wherein said means for moving said inner manifold comprises means for moving said inner manifold axially.

3. A rake-type sootblower as recited in claim 2 wherein said bushing means comprises separate bushings on each side of each of said openings in said tube.

4. A rake-type sootblower as recited in claim 1 wherein said means for moving said inner manifold comprises means for rotating said inner manifold and wherein said holes in said inner manifold are circumferential and axially spaced from each other whereby rotation of said inner manifold separately and alternately aligns one of said holes with an associated one of said openings.

5. A rake-type sootblower as recited in claim 4 wherein said bushing means comprises a solid bushing adjacent each of said openings with an aperture aligned with said opening whereby the rotation of said inner manifold separately and alternately aligns one of said apertures and openings.

* * * * *